US008539902B2

(12) United States Patent
Sanvik

(10) Patent No.: US 8,539,902 B2
(45) Date of Patent: Sep. 24, 2013

(54) DEVICE FOR DISPLAYING A FLAG

(75) Inventor: Thomas Sanvik, Norrkoping (SE)

(73) Assignee: Ostergotlands Fastighetsservice Samt el Och Larm I Norrkoping AB, Norrkoping (SE)

( * ) Notice: Subject to any disclaimer, the term of this patent is extended or adjusted under 35 U.S.C. 154(b) by 358 days.

(21) Appl. No.: 13/056,021

(22) PCT Filed: Jun. 18, 2009

(86) PCT No.: PCT/SE2009/000307
§ 371 (c)(1),
(2), (4) Date: Jan. 26, 2011

(87) PCT Pub. No.: WO2010/016788
PCT Pub. Date: Feb. 11, 2010

(65) Prior Publication Data

US 2011/0139058 A1 Jun. 16, 2011

(30) Foreign Application Priority Data

Aug. 5, 2008 (SE) ..... 0801760

(51) Int. Cl.
*G09F 17/00* (2006.01)
*E04H 12/32* (2006.01)

(52) U.S. Cl.
USPC ..... 116/173

(58) Field of Classification Search
USPC ..... 116/173, 174, 175; 40/601, 606.14, 40/606.15
See application file for complete search history.

(56) References Cited

U.S. PATENT DOCUMENTS

| | | | | |
|---|---|---|---|---|
| 659,280 | A * | 10/1900 | Beaver | 116/173 |
| 950,867 | A * | 3/1910 | Ruggles | 116/175 |
| 960,669 | A * | 6/1910 | Morgan | 116/173 |
| 2,533,459 | A * | 12/1950 | Holliday | 116/173 |
| 3,300,185 | A | 1/1967 | Metzger et al. | |
| 3,850,401 | A | 11/1974 | Snediker | |
| 4,332,210 | A | 6/1982 | Lambert | |
| 4,471,873 | A | 9/1984 | Thomas | |
| 5,572,835 | A | 11/1996 | Atkins et al. | |
| 6,014,942 | A | 1/2000 | Perka et al. | |
| 6,572,060 | B2 * | 6/2003 | Yoon | 248/163.1 |
| 6,883,459 | B2 | 4/2005 | Maki | |
| 8,191,497 | B2 * | 6/2012 | McCudden et al. | 116/173 |
| 2005/0099105 | A1 | 5/2005 | Thompson | |

FOREIGN PATENT DOCUMENTS

CN 200943333 Y * 9/2007

OTHER PUBLICATIONS

International Search Report, dated Oct. 13, 2009, from corresponding PCT application.

* cited by examiner

*Primary Examiner* — Richard A. Smith
(74) *Attorney, Agent, or Firm* — Young & Thompson

(57) ABSTRACT

A device for displaying a flag includes a raisable and lowerable flag container (12) provided with an arrangement for extending or retracting a flag, and a raisable and lowerable flag cassette (6) provided with several flag containers (12). The device for displaying a flag is provided with a control unit (5) from which the device for displaying a flag may be controlled. The flag container (12) in the flag cassette is provided with a device for pivoting the flag container from being essentially parallel to the flag pole into an essentially orthogonal angle relative to the flag pole and a device for extending or retracting a flag in the flag container, where the control unit (5) is arranged to first pivoting a flag container and then extending a flag in the flag container.

11 Claims, 3 Drawing Sheets

DEVICE FOR DISPLAYING A FLAG

The present invention relates to a device for displaying a flag according to the introductory portions of the independent claim.

BACKGROUND OF THE INVENTION

By for example U.S. Pat. No. 6,883,459 is known a device for displaying a flag that is able to raise and lower a flag without manual intervention. The device for displaying a flag comprises a narrow slit extending vertically through which the flag is pulled in horizontally when the pole is lowered and from which the flag is released when the pole is raised. The flag may crumble up at the bottom of the slit and get stuck when wound up. If one wants to change flag, this has to be manually exchanged which is not very practical, especially when it in certain contents is desirable to display flags with national flags of visitors or flags that portrays various visiting companies logotypes. The device for displaying flags according to U.S. Pat. No. 6,883,459 may be provided with a timer but does provide for any further possibilities to adapt the automated display of flags.

U.S. Pat. No. 4,332,210 discloses a device for winding up flags that is intended to extend essentially horizontally. This facilitates in particular by winding up a flag, but the device is not intended for use with flag poles.

An object of the invention is therefore to provide a device for displaying a flag which allows any one of several flags to be displayed without the need for manual exchange of flags.

These and other objects are attained by a device for displaying a flag according to the characterising portions of the independent claim.

SUMMARY OF THE INVENTION

The invention relates to a device for displaying a flag. It comprises at least one raisable and lowerable flag container 12 provided with an arrangement for extending or retracting a flag. The device comprises a raisable and lowerable flag cassette 6 provided with several flag containers 12. The device for displaying a flag is provided with a control unit 5 from which the device for displaying a flag may be controlled. At least one flag container 12 in the flag cassette is provided with a device for pivoting the flag container from being essentially parallel to the flag pole into an essentially orthogonal angle relative to the flag pole and a device for extending or retracting a flag in the flag container, where the control unit 5 is arranged to first pivoting a flag container and then extending a flag in the flag container.

With such a device, the cassette may be raised to the desired height, a flag container flipped out such that it extends parallel to the ground, and a flag made from a fabric like substance, may be rolled out. Advantageously, the process is easily reversed by the flag being rolled up into the container, and the container pivoted down into the cassette.

The invention further relates to such a device that is fully automated and may be controlled remotely.

DESCRIPTION OF PREFERRED EMBODIMENTS

Figure 1:
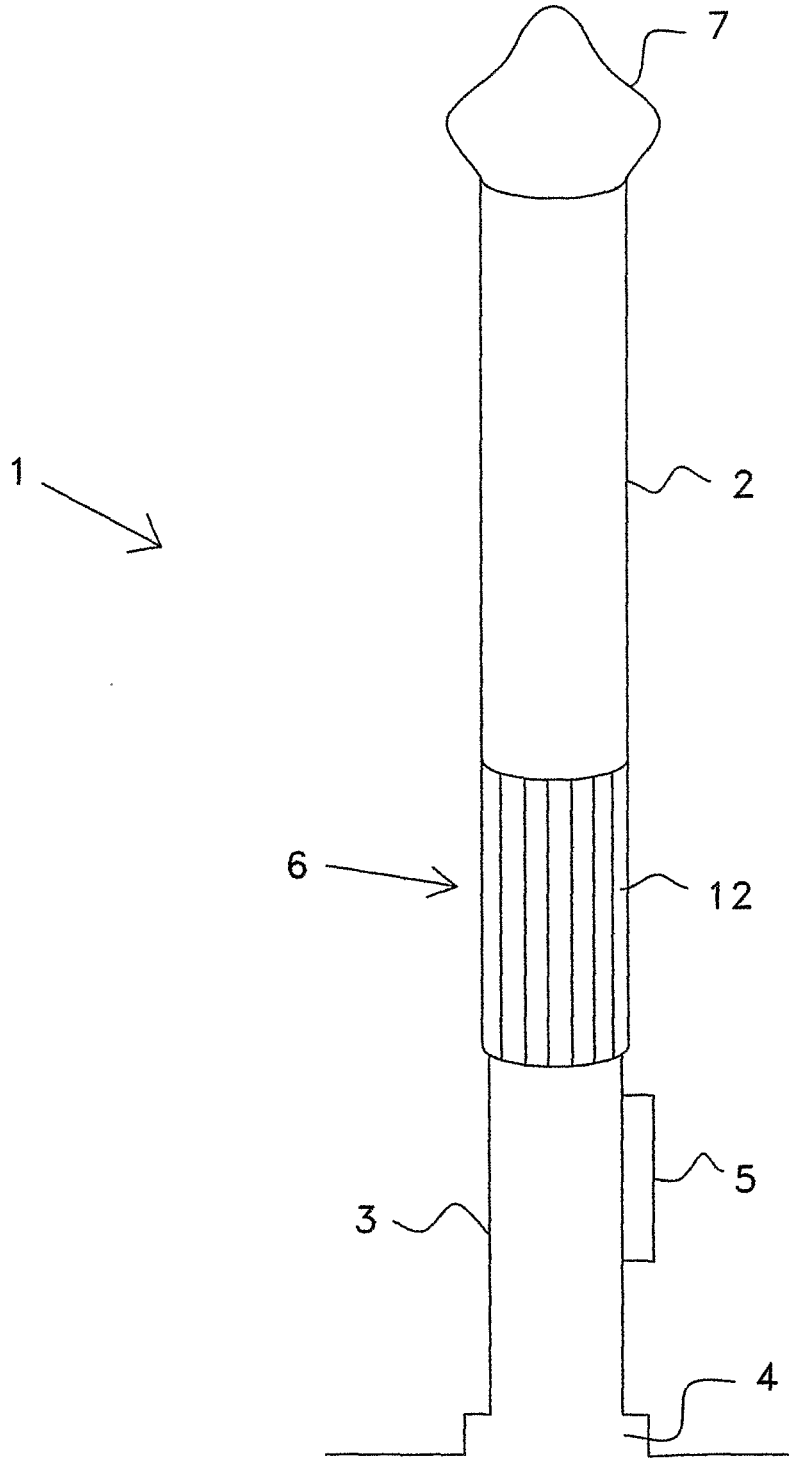
FIG. 1 shows a first embodiment of the invention

FIG. 1 shows a first embodiment of a flag pole 1 according to the invention. The flag pole comprises a fixed part 3 and part 2 with is moveable with respect to the fixed part. The fixed lower part is at its lower end tiltably attached to a foot 4 and control box 5 for controlling the flag is arranged at the fixed part. The moveable part 2 comprises a pipe part of larger diameter than the lower, fixed part, and is slipped over the lower part such that it may slide over it. In the figure the moveable part is fully slipped over the fixed part and may from this position be extended until the flag pole in it entirety achieves full height.

The moveable part 2 does at its upper end comprise a knob 7, and a flag cassette 6 is arranged on the moveable part. The flag cassette 6 comprises a series of holders, each of which may hold a flag. Each holder in the cassette comprises a drive unit that is able to roll out and roll in a flag onto an axle. This may be done using motors or pneumatics. Using the flag cassette, single flags may be rolled out and this is controlled from the control box. The flag cassette may be steered to a height corresponding to half mast or full mast.

Using the cassette, different flags from a chosen set may be selected for various purposes; national flags, regional flags or flags with a company logo may be selected. In a not illustrated embodiment, the cassette has several holders arranged on top of each other, such that the cassette may be used for simultaneously displaying several flags arranged above each other.

The flag pole may be controlled to perform various tasks manually using the control box, remotely via internet, sms or in some other way and it may be programmed in advance to display preselected flags at preselected times. Control of a flag or a group of flags may be done via an interface accessible via internet, such that an operator using any chosen terminal may program timer controlled display of flags, change previously made programming or make particular additions for the display of single flags or groups of flag on request.

Figure 2:
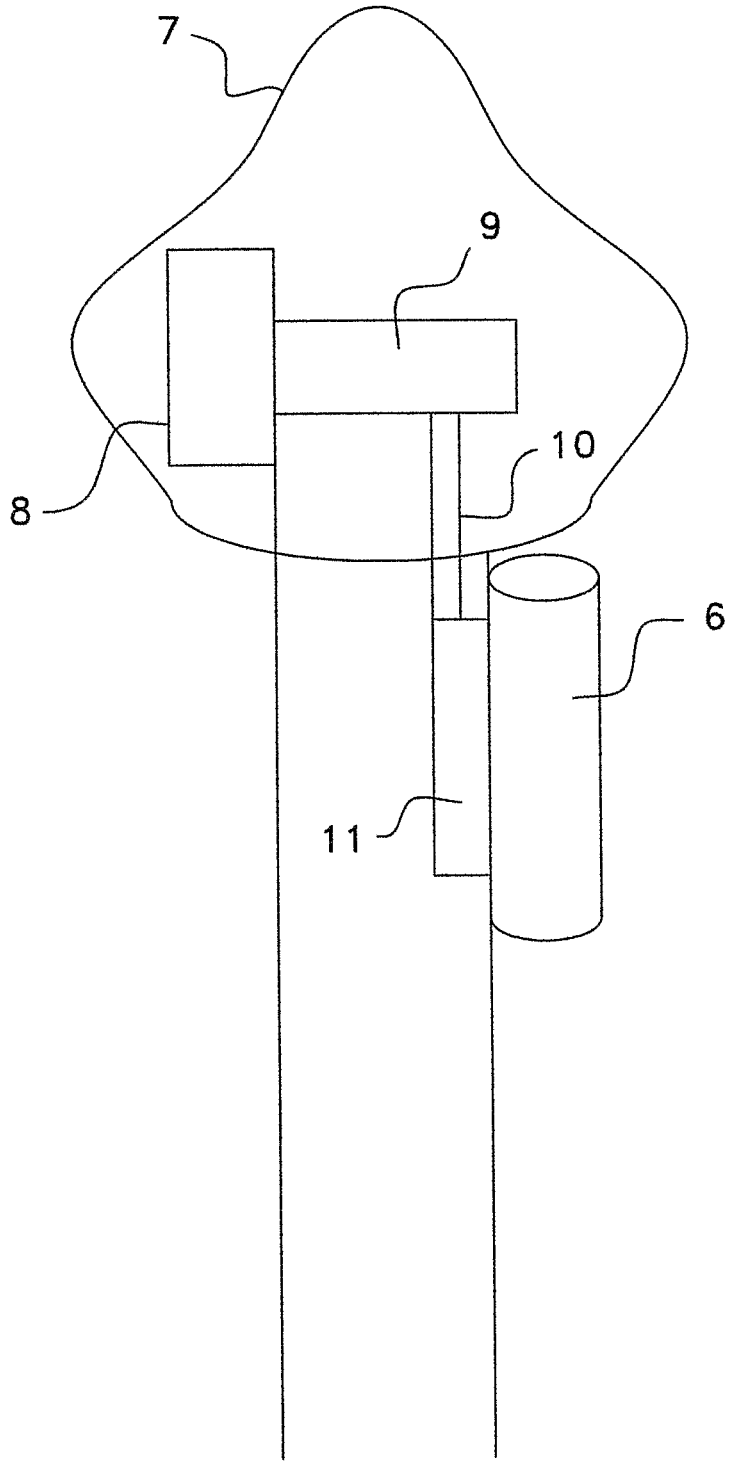
FIG. 2 shows a part of a second embodiment of the invention

FIG. 2 shows a second embodiment of the invention, where only the upper part of a flag pole is illustrated. The figure shows how a steering unit for the cassette 6 is arranged in the knob 7 of the pole. The steering unit comprises a motor 8 with and axle 9 around which a wire 10 may be wound. The wire 10 is attached to a foot part 11 of the cassette 6 which runs in a recess in the flag pole. When the motor is activated to rotate in a first direction, the wire is wound onto the axle and the cassette is pulled towards the top of the flag pole. When the motor is activated to rotate in a second direction, the wire is unwound from the axle and the cassette moves towards the foot of the flag pole. The cassette is provided with a motor driven device that may release and wind in at least one flag.

Figure 3:
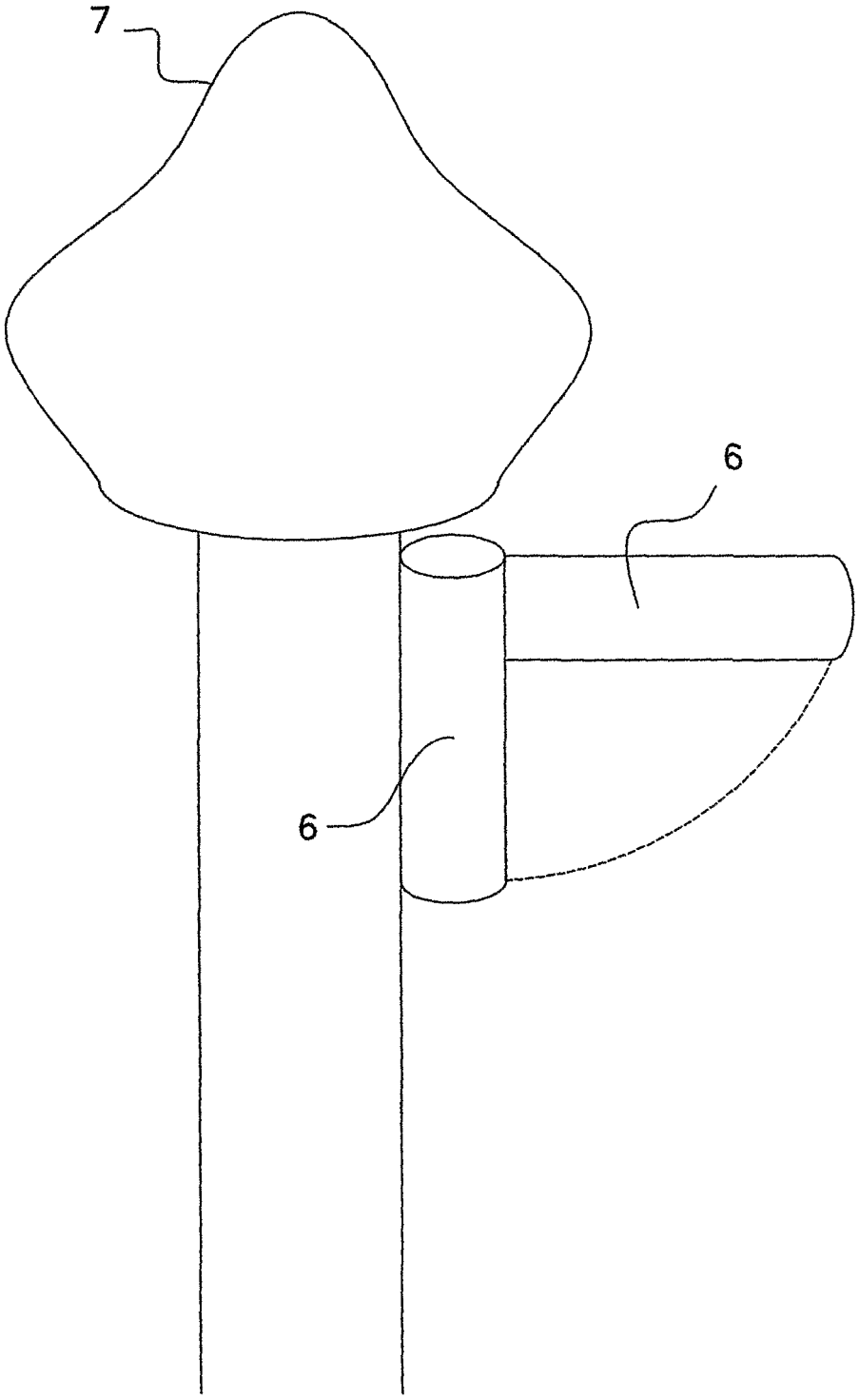
FIG. 3 shows a part of a third embodiment of the invention

FIG. 3 shows part of a third embodiment of the invention where as I FIG. 2 only the upper part of a flag pole is illustrated. On the flag pole is arranged a cassette 6 that may be risen and lowered along the flag pole in a way corresponding to the previous embodiments. The cassette is further arranged to be able to swivel a flag container out from the top of the upper edge of the cassette, such that the container extends orthogonally from the flag pole. With the container in this extended position, the flag may more easily be wound out and then naturally falls straight down. With the flag in this position, the winding in of the flag into the container is facilitated when the flag is to be lowered.

In both the second and third embodiments are for sake of simplicity only one of the containers in the flag container illustrated, but all embodiments are intended to comprise such a cassette with several containers. The invention may be supplemented with solar cells, a wind power plant or with rechargeable batteries.

The invention claimed is:

1. A device for displaying a flag, comprising:

a flag cassette (6) that is arranged to be raised and lowered on a flag pole and that is provided with several flag containers (12); and a control unit (5) from which the device for displaying a flag is controlled, wherein at least one of said flag containers (12) is provided with an arrangement for pivoting the respective flag container from being essentially parallel to the flag pole into an essentially orthogonal angle relative to the flag pole and for extending or retracting a flag in the respective flag container, and wherein the control unit (5) is arranged for first pivoting the respective flag container and then extending the flag in the respective flag container.

2. The device for displaying a flag according to claim 1, wherein said control unit (5) is arranged to control the device for displaying a flag at half mast or at full mast.

3. The device for displaying a flag according to claim 2, wherein a first plurality of said flag containers include said arrangement and wherein said control unit (5) is arranged to extend or retract the respective flag in each of said first plurality of flag containers.

4. A device for displaying a flag according to claim 2, further comprising a central control device that controls said control unit (5).

5. The device for displaying a flag according to claim 1, wherein a first plurality of said flag containers include said arrangement and wherein said control unit (5) is arranged to extend or retract the respective flag in each of said first plurality of flag containers.

6. A device for displaying a flag according to claim 5, further comprising a central control device that controls said control unit (5).

7. The device for displaying a flag according to claim 1, further comprising a central control device that controls said control unit (5).

8. A device for displaying a flag, comprising:

a flag cassette (6) that is arranged to be raised and lowered on a flag pole and that is provided with several flag containers (12); and a control unit (5) from which the device for displaying a flag is controlled, wherein at least one of said flag containers (12) is provided with an arrangement for extending or retracting a flag in the respective flag container with the respective flag container in a position essentially parallel to the flag pole.

9. The device for displaying a flag according to claim 8, wherein said control unit (5) is arranged to control the device for displaying a flag at half mast or at full mast.

10. The device for displaying a flag according to claim 8, wherein a first plurality of said flag containers include said arrangement and wherein said control unit (5) is arranged to extend or retract the respective flag in each of said first plurality of flag containers.

11. The device for displaying a flag according to claim 8, further comprising a central control device that controls said control unit (5).

* * * * *